United States Patent [19]

Elert et al.

[11] 4,372,143

[45] Feb. 8, 1983

[54] APPARATUS FOR FORMING A DOMED BOTTOM IN A CAN BODY

[75] Inventors: Karl Elert, Brookfield; John C. Westphal, Franklin, both of Wis.

[73] Assignee: Jos. Schlitz Brewing Company, Milwaukee, Wis.

[21] Appl. No.: 195,742

[22] Filed: Oct. 10, 1980

[51] Int. Cl.[3] ..... B21D 22/24

[52] U.S. Cl. ..... 72/343; 72/347; 72/349

[58] Field of Search ..... 72/345, 347, 354, 348, 72/343, 349, 352, 353

[56] References Cited

U.S. PATENT DOCUMENTS

| | | | |
|---|---|---|---|
| 3,771,345 | 11/1973 | Paramonoff | 72/349 |
| 4,007,621 | 2/1977 | Franel et al. | 72/347 |
| 4,289,014 | 9/1981 | Maeder et al. | 72/348 |

*Primary Examiner*—Leon Gilden

*Attorney, Agent, or Firm*—Andrus, Sceales, Starke & Sawall

[57] ABSTRACT

An apparatus for forming an inward dome in the bottom wall of a metal can body having a beveled peripheral edge bordering the bottom wall. The apparatus includes a housing which supports a convex die member adapted to engage the bottom wall of the can body to form the dome. A pressure ring is disposed radially outward of the die member and is mounted for sliding movement with respect to the die member. The pressure ring is provided with a beveled surface which is adapted to be engaged by the beveled edge of the can body to prevent deformation of the bevelled edge as the dome is formed in the bottom wall. The pressure ring is connected to an air spring which provides uniform resistance to movement of the ring relative to the die member. In addition, the housing and die member are connected through a second air spring to a fixed support and after the dome has been formed, continued axial movement of the can body will result in compression of the second air spring to insure full formation of the dome.

9 Claims, 6 Drawing Figures

Fig.1
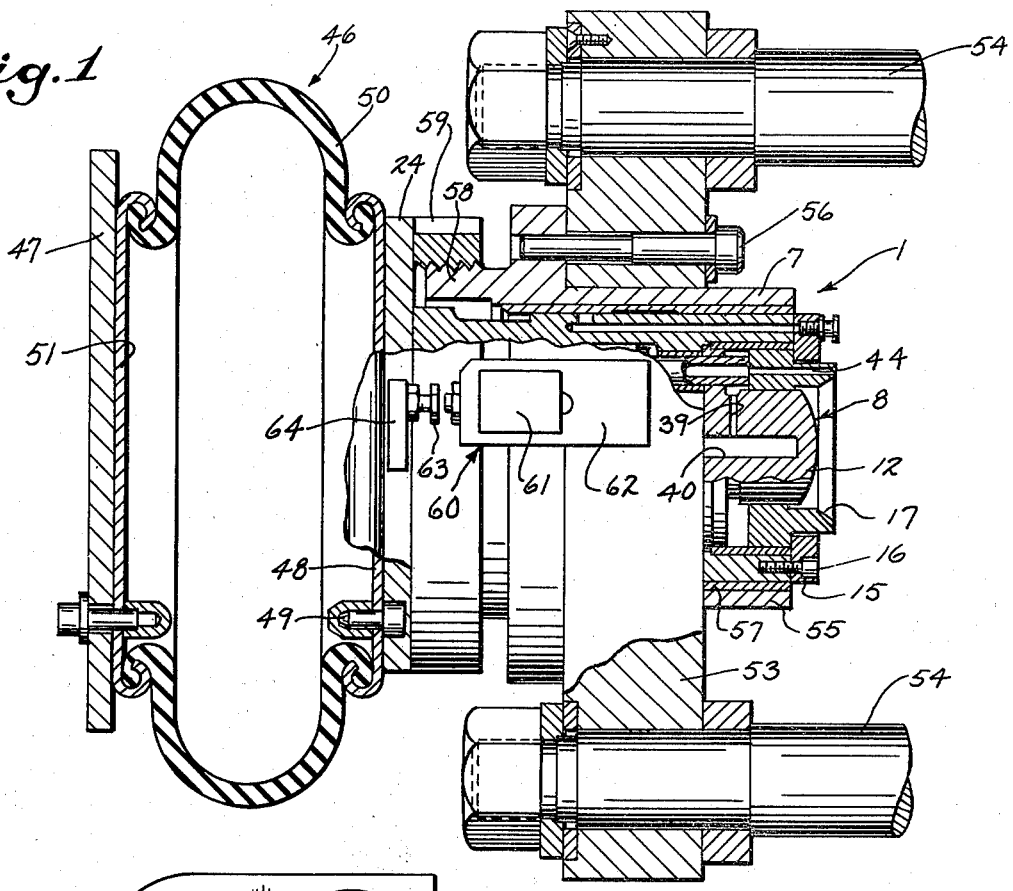
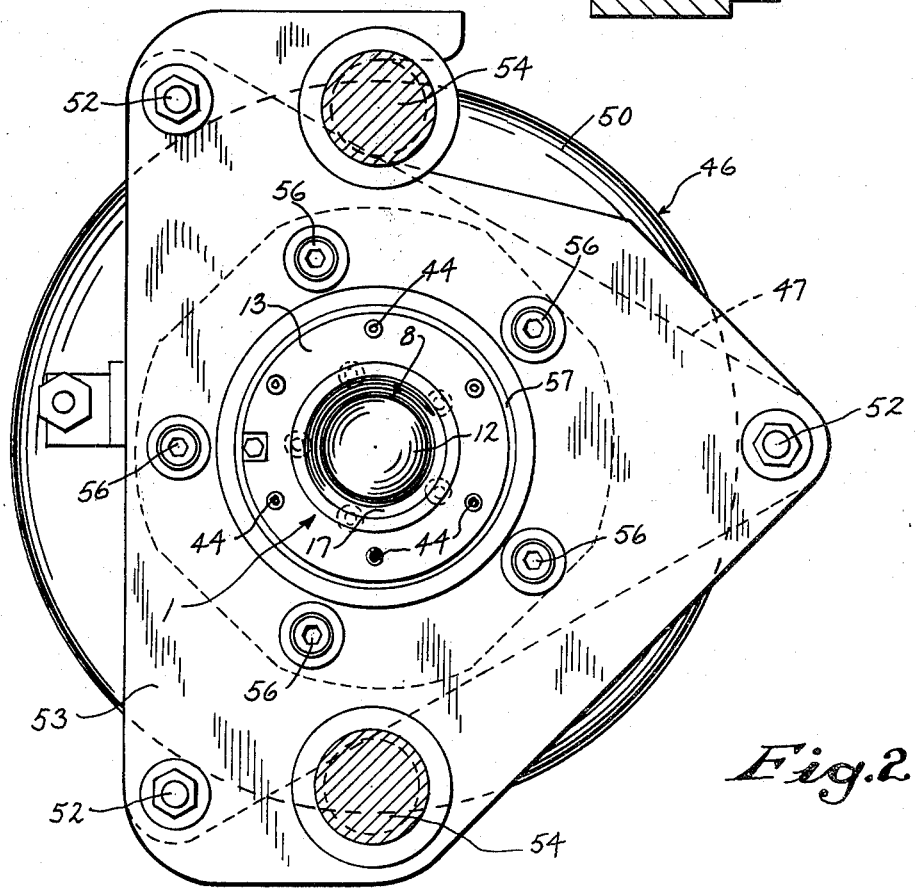
Fig.2

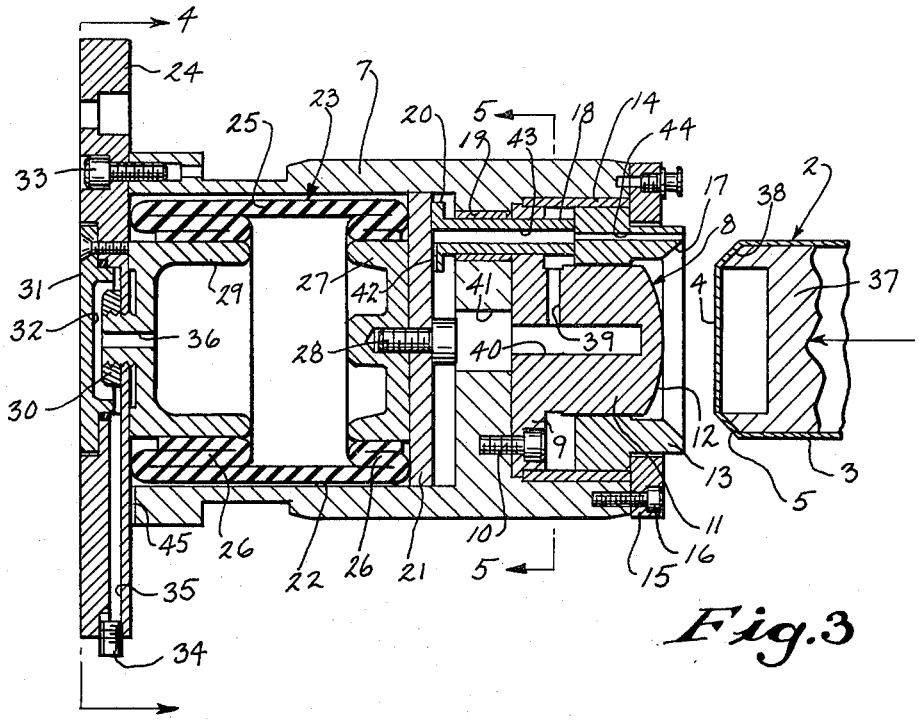
Fig. 3
Fig. 4
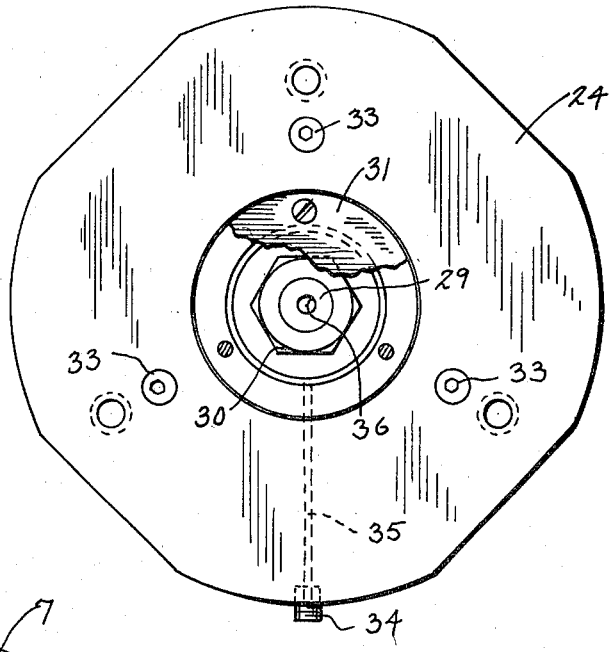
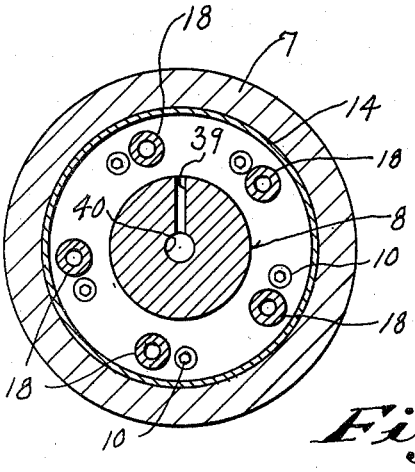
Fig. 5
Fig. 6
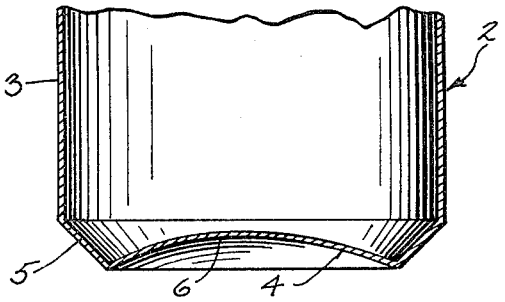

APPARATUS FOR FORMING A DOMED BOTTOM IN A CAN BODY

BACKGROUND OF THE INVENTION

One-piece can bodies, meaning can bodies in which the cylindrical side wall is formed integrally with the bottom wall, are normally formed by a drawing and ironing operation. To provide increased strength for the bottom wall to resist the internal pressure of the contained liquid, certain can bodies, in the past, have been formed with a radius along the peripheral edge of the bottom wall and a central inwardly extending dome or concavity.

More recently, one-piece can bodies have been formed with an inwardly beveled edge along the periphery of the bottom wall which borders a central dome or concavity of smaller diameter. This configuration increases the strength of the bottom wall, enabling the bottom wall to be formed of lesser gauge metal and results in a substantial cost saving. However, in forming the central dome, there is a tendency for the beveled peripheral edge to be wrinkled or deformed which can adversely effect the strength characteristics of the bottom wall. Consequently, doming dies have included a pressure ring which is adapted to engage the beveled edge as the dome is being formed, and in conjunction with a punch on the inside of the can body, aid in preventing the beveled edge from being deformed. In the conventional doming mechanism, the pressure ring is connected to a plurality of air bags which are located outwardly of the die assembly. The air bags provide a substantially uniform reactive force against the beveled edge as the dome is being formed, to thereby prevent wrinkling or other deformation in the beveled edge.

SUMMARY OF THE INVENTION

The invention is directed to an improved apparatus for forming a central dome in the bottom wall of a one-piece metal can body having a peripheral beveled edge. More specifically, the apparatus includes an outer housing, and a die, having an outer convex die surface, is supported by the housing and is adapted to engage the bottom wall of the can body to form the inwardly extending dome or concavity in the bottom wall.

A pressure ring is disposed radially outward of the die and is mounted for sliding movement relative to the die. The pressure ring is connected to one end of a pressurized air spring through a series of plungers which are mounted concentrically around the die, while the opposite end of the air spring is attached to a pressure plate.

As the can body is moved toward the die, the beveled edge on the can body will engage a beveled surface on the pressure ring and the central portion of the bottom wall of the can body will engage the convex die surface on the die. Continued axial movement of the can body will form the dome or concavity in the bottom wall of the can body and move the pressure ring longitudinally with respect to the die against the pressure of the air spring. The air spring provides a substantially uniform resistance to movement of the pressure ring, thereby preventing wrinkling or deformation of the beveled edge during the dome forming operation.

The housing and pressure plate are connected through a second air spring to a fixed supporting structure, and when the pressure ring has been moved inwardly into engagement with a fixed stop, continued axial movement of the can body will compress the second air spring to thereby provide a degree of over-ride and ensure the complete formation of the dome in the bottom wall of the can body.

The doming apparatus of the invention is a more compact unit than those used in the past, and the pressure ring air spring is completely enclosed and protected by the outer housing, eliminating the possibility of damage to the spring and thereby reducing potential maintenance costs.

As a further advantage, the apparatus of the invention does not required any sliding seals, which again reduces the overall cost of the unit and decreases maintenance expense.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the doming apparatus of the invention with parts broken away in section;

FIG. 2 is an end view of the construction of the doming apparatus shown in FIG. 1;

FIG. 3 is an enlarged longitudinal section showing the doming die, pressure ring and air spring assembly;

FIG. 4 is a section taken along line 4—4 of FIG. 3;

FIG. 5 is a section taken along line 5—5 of FIG. 3; and

FIG. 6 is a longitudinal section of a completed can body.

DESCRIPTION OF THE PREFERRED EMBODIMENT

FIG. 1 shows a doming apparatus 1 for forming an inwardly extending dome or concavity in the bottom wall of a one-piece can body 2. The can body 2 includes a cylindrical side wall 3 and a bottom wall 4. As illustrated in FIG. 6, the bottom wall is provided with an inwardly beveled edge portion 5, which borders a central dome or concavity 6. The apparatus 1 of the invention is adapted to form the dome 6, while preventing wrinkling or deformity of the previously formed beveled edge 5.

As best illustrated in FIG. 3, the doming apparatus 1 includes a generally cylindrical housing 7 having an open forward end and a die 8 is located within the open end of the housing. Die 8 includes an annular base flange 9 which is secured to the housing 7 by a series of bolts 10. A cylindrical central portion 11 extends forwardly from the base flange 9 and terminates in a domed or convex die surface 12 which is adapted to engage the bottom wall 4 of the can body to form the dome 6.

Located outwardly of the central portion 11 of the die 8 is a pressure ring 13 and the pressure ring is mounted for sliding movement with respect to the die and housing by a bushing 14 which is mounted on housing 7. The pressure ring 13 is maintained within the open end of the housing by a retaining ring 15 which is secured to the housing by a plurality of bolts 16.

As best illustrated in FIG. 3, the forward end of the pressure ring 13 is provided with a beveled surface 17, and as the can body 2 is moved axially into engagement with the pressure ring 13, the beveled edge 5 of the can body will engage the beveled surface 17 on the pressure ring.

The inner end of the pressure ring 13 bears against the outer ends of a series of plungers 18 which are mounted for sliding movement within bushings 19 that are secured within openings in the central transverse wall of the housing 7. The inner end of each plunger 18 is provided with an enlarged base 20 which engages the forward surface of a plate 21.

Plate 21 is located in the forward end of a chamber 22 formed in the rear portion of housing 7, and plate 21 is connected through an air spring assembly 23 to a pressure plate 24. The air spring assembly 23 includes a generally cylindrical, flexible bag 25 made of rubberized material, or the like, and the ends of the bag 25 are provided with reverse folds, as indicated by 26. The forward end of the bag 25 is bonded to a support disc 27 which is mounted on plate 21 by bolt 28, while the opposite end of the bag 25 is bonded to the annular flange of a cup-shaped support 29 which is connected to the pressure plate 24. As best illustrated in FIG. 3, the cup-shaped support 29 is provided with a central threaded boss 30 which extends through an opening in the pressure plate 24 and receives a nut 30. A cap 31 is secured within a recess in the outer surface of pressure plate 24 and is spaced from the nut 30, as shown in FIG. 3, to form a chamber 32. The pressure plate is connected to the housing 7 through bolts 33, so that the housing 7, pressure plate 24 and the cup-shaped support 29 constitutes an integral unit.

The air spring assembly 23 is pressurized and is adapted to maintain a substantially uniform pressure as the bag 25 is compressed and expanded. To supply air to the air spring assembly 23, an air line 34 is connected between a suitable source of air under pressure and a passage 35 which extends radially of pressure plate 24. The inner end of passage 34 communicates with central chamber 32, and support 29 is provided with an axial bore 36 which provides communication between the chamber 32 and the interior of the bag 25. The pressure within the air spring assembly 23 is normally maintained at a value in the range of about 30 to 50 psi.

The can body 2 is moved toward the doming apparatus by an internal punch 37 having a beveled peripheral edge portion 38 that mates with beveled edge 5 of the can body. The beveled edge 5 of the can body will initially engage the beveled surface 17 on the pressure ring 13. Immediately thereafter, the bottom wall 4 of the can body will engage the domed surface 12 on the die 8 and continued axial movement of the can body will form the dome 6 in the bottom wall. As the dome is being formed, the can body will move the pressure ring 13 rearwardly, relative to the die, against the pressure within the air spring assembly 23. As previously noted, the pressure within the air spring bag 25 will remain relatively constant as the bag is being compressed so that the resistance applied to movement of the pressure ring will be substantially uniform throughout its stroke of travel. This prevents wrinkling or other deformation of the beveled edge 5 on the can body.

To relieve air or lubricating liquid which may be trapped behind the pressure ring 13, the die 8 is provided with a radial passage 39 which communicates with a central recess 40. Recess 40 connects with a hole 41 in the central wall of the housing. The base 20 of each of the plungers 18 is provided with a groove 42, and the groove 42 communicates with the central bore 43 in the plunger, and each bore, in turn, is connected to the respective axial passage 44 in the pressure ring. With this construction, air or liquid located in the area between the base 9 of the die and the pressure ring 13 will be relieved through the passage 39, recess 40, hole 41, grooves 42, bores 43 and passages 44 to the exterior.

As the air spring 23 is compressed and expanded during the cycle of operation, air can be introduced and vented from chamber 22 through holes 45 in the end of housing 7.

The doming apparatus also includes a second air spring assembly 46 which is connected between the pressure plate 24 and a fixed generally triangular support 47. As shown in FIG. 1, the pressure plate 24 is connected to a disc 48 through bolts 49 and the peripheral edge of the disc 48 is crimped to one end of a flexible bag 50. The opposite end of the bag 50 is crimped to disc 51 which is mounted on the fixed support plate 47.

The support plate 47 is connected by a series of tie rods 52 to a yoke 53 and the yoke, in turn, is connected by tie rods 54 to the main frame of the machine. With this construction, the yoke 53 and triangular plate 47 constitute a fixed support.

An outer housing 55 is connected to the yoke 53 through bolts 56 and the housing 7 is mounted for sliding movement with respect to the housing 55 by bushing 57.

Extending rearwardly from the outer housing 55 is an annular threaded flange 58, and a nut 59, which is secured to the forward face of pressure plate 24, is threaded on the threaded flange 58. Adjustment of the nut 59 on the threaded flange 58 provides an initial set-up adjustment in which the entire doming apparatus can be moved axially relative to the punch.

The apparatus also includes a sensing assembly 60 which will shut off operation of the apparatus in the event the bag 50 is compressed beyond a predetermined setting. The sensing assembly 60 is shown in FIG. 1, and includes a proximity sensor 61 which is mounted on bracket 62 attached to fixed yoke 53. The proximity sensor 61 is adapted to sense the position of an adjustable element 63 which is mounted on bar 64 attached to the pressure plate 24. During the doming operation, if the gap between the sensor 61 and the element 63 increases beyond a predetermined maximum due to excessive compression of bag 50, the sensor 60 will trigger a switch in the electrical circuit to stop operation of the apparatus. The sensing assembly will come into play in the event more than one can body may be nested together and introduced into the doming apparatus, or in the event a metal chip or other foreign material, may lodge between the bottom wall of the can body and the die 8.

The apparatus provides a compact and inexpensive doming apparatus for forming the central dome in a one-piece can body without wrinkling or other deformation of the beveled peripheral edge of the bottom wall. The air springs are located in-line with the die 8 and the air spring 23 is completely enclosed by the housing 7 to prevent damage to the bag 25, thereby reducing potential maintenance costs.

While the above description has shown the can body 2 being moved axially relative to the doming apparatus, it is contemplated that the can body can be stationary and the doming apparatus can be moved with respect to the can body.

Various modes of carrying out the invention are contemplated as being within the scope of the following claims particularly pointing out and distinctly claiming the subject matter which is regarded as the invention.

We claim:

1. An apparatus for forming an inwardly extending dome in the bottom wall of a metallic one-piece can body having a beveled peripheral edge bordering the bottom wall, comprising, a die having an outer convex surface disposed to engage the bottom wall of the can body to form the dome therein, a pressure ring having an annular beveled surface and disposed radially outward of the die and mounted for sliding movement relative to said die, a pressure member spaced longitudinally from said die, a gas spring assembly including a single flexible bag interconnecting the pressure ring having an annular beveled surface and and the pressure member, said bag being disposed coaxially of said die, and an annular pressure transmitting member interconnecting said die and said pressure member, said pressure transmitting member disposed radially outward of said gas spring assembly and enclosing said bag, engagement of the beveled edge of said can body with the beveled surface on the pressure ring causing said pressure ring to move relative to said die against the pressure within said gas spring assembly to provide substantially uniform resistance throughout the stroke of movement of said pressure ring, and engagement of the bottom wall of the can body with said convex die surface serving to form the dome in said bottom wall.

2. The apparatus of claim 1, and including a plurality of plungers mounted for sliding movement with respect to the housing and interconnecting the pressure ring and the gas spring assembly, said plungers being disposed radially outward of said die member.

3. The apparatus of claim 1, and including gas supply means for supplying gas under pressure to the bag of said gas spring assembly.

4. The apparatus of claim 1, wherein said bag is generally cylindrical in configuration and at least one end portion of the bag is provided with a reverse overlapping fold whereby compression of said bag will cause enlargement of said fold.

5. The apparatus of claim 1, and including a stop connected to the housing and disposed to be engaged by the inner end of said pressure ring to limit the inward movement of said pressure ring, and fluid relief means connected between the exterior and the space between the inner end of the pressure ring and the housing to relieve the fluid pressure therein as the pressure ring is moved inwardly.

6. The apparatus of claim 1, and including a fixed supporting structure, and a second gas spring assembly interconnecting the pressure member and the fixed supporting structure, said second gas spring assembly including a second flexible bag disposed coaxially of said first named bag, continued axial movement of the can body after formation of said dome in the end wall acting to compress said second bag.

7. The apparatus of claim 6, and including proximity sensor means for stopping operation of the apparatus, said sensing means comprising a first sensing element disposed on said fixed supporting structure and a second sensing element connected to said second gas spring assembly, said sensing elements being arranged so that compression of said second bag will result in an increase in spacing between said sensing elements, an increase in spacing beyond a predetermined amount acting to stop operation of said apparatus.

8. An apparatus for forming an inwardly extending dome in the bottom of a metallic one-piece can body having a beveled peripheral edge bordering the bottom wall, comprising a doming die having an outer generally convex die surface disposed to engage the bottom wall of the can body to form the dome therein, a pressure ring disposed radially outward of the die and mounted for sliding movement relative to said die, a pressure member spaced axially of the die, annular pressure tansmitting means interconnecting the die and said pressure member and including a generally cylindrical housing, a plurality of plungers engaged with the inner end of the pressure ring and disposed concentrically of said die, said plungers being mounted for sliding movement within openings in said pressure transmitting means, a first gas spring assembly interconnecting the plungers and said pressure member, said first gas spring assembly comprising a single flexible bag disposed coaxially of said die and located within said housing, engagement of the beveled edge on said can body with the beveled surface on the pressure ring causing said pressure ring to move relative to said die against the pressure within said bag to provide substantially uniform resistance throughout the stroke of movement of said pressure ring and engagement of the bottom wall of the can body with said convex die surface serving to form the dome in said bottom wall, a fixed supporting structure, and a second gas spring assembly including a second flexible bag disposed coaxially of said first bag and interconnecting said pressure member with said fixed supporting surface, and means for supplying gas under pressure to the interior of both of said bags.

9. The apparatus of claim 8, and including a pressure plate interposed between the inner ends of said plungers and said first bag, said pressure plate being mounted for sliding movement within the housing of said pressure transmitting means.

* * * * *

UNITED STATES PATENT AND TRADEMARK OFFICE

CERTIFICATE OF CORRECTION

PATENT NO. : 4,372,143

DATED : February 8, 1983

INVENTOR(S) : KARL ELERT ET AL

It is certified that error appears in the above-identified patent and that said Letters Patent is hereby corrected as shown below:

Col. 5, line 15, CLAIM 1, Delete "having an annular beveled surface and"; Col. 6, line 21, CLAIM 8, After "ring" insert ---having an annular beveled surface and---

Signed and Sealed this

*Fifth* Day of *July 1983*

[SEAL]

*Attest:*

GERALD J. MOSSINGHOFF

*Attesting Officer*

*Commissioner of Patents and Trademarks*